US011234462B2

(12) United States Patent
Wang et al.

(10) Patent No.: US 11,234,462 B2
(45) Date of Patent: Feb. 1, 2022

(54) HIGH-COMFORT ELECTRONIC CIGARETTE MOUTHPIECE

(71) Applicant: SHENZHEN RELX TECHNOLOGY CO., LTD., Shenzhen (CN)

(72) Inventors: Hui Wang, Shenzhen (CN); Yao Fu, Shenzhen (CN)

(73) Assignee: SHENZHEN RELX TECHNOLOGY CO., LTD., Shenzhen (CN)

( * ) Notice: Subject to any disclaimer, the term of this patent is extended or adjusted under 35 U.S.C. 154(b) by 67 days.

(21) Appl. No.: 16/632,529

(22) PCT Filed: Dec. 27, 2019

(86) PCT No.: PCT/CN2019/129441
§ 371 (c)(1),
(2) Date: Jan. 20, 2020

(87) PCT Pub. No.: WO2020/135782
PCT Pub. Date: Jul. 2, 2020

(65) Prior Publication Data

US 2021/0059302 A1 Mar. 4, 2021

(30) Foreign Application Priority Data

Dec. 29, 2018 (CN) ..... 201822256268.8

(51) Int. Cl.
*A24F 17/00* (2006.01)
*A24F 13/00* (2006.01)
*A24F 40/40* (2020.01)

(52) U.S. Cl.
CPC ..... *A24F 40/40* (2020.01)

(58) Field of Classification Search
CPC ..... A24F 40/40; A24F 40/60
See application file for complete search history.

(56) References Cited

U.S. PATENT DOCUMENTS

2006/0016453 A1 1/2006 Kim
2009/0235939 A1* 9/2009 Gonsalves ..... A24F 15/10 131/191

(Continued)

FOREIGN PATENT DOCUMENTS

CN 202664224 U 1/2013
CN 204180933 U 3/2015

(Continued)

OTHER PUBLICATIONS

Evaluation Report of corresponding China Utility Model Patent Application No. 201822256268.8 completed on Dec. 30, 2019.

(Continued)

*Primary Examiner* — Abdullah A Riyami
*Assistant Examiner* — Thang H Nguyen
(74) *Attorney, Agent, or Firm* — Idea Intellectual Limited; Margaret A. Burke; Sam T. Yip

(57) ABSTRACT

Embodiments of the present disclosure disclose a high-comfort electronic cigarette mouthpiece. A center of the mouthpiece is provided with a vent penetrating through the mouthpiece. Two ends of the mouthpiece are respectively an air inlet end and an air outlet end, and the cross-section of the mouthpiece gradually decreases from the air inlet end to the air outlet end in a streamlined manner, which is of a date-pit shape, an eye shape, or an oval shape that is pointed at two side portions and bulging in a middle portion. In the embodiments of the present disclosure, the high-comfort electronic cigarette mouthpiece is designed to be of a streamlined shape that is pointed at two side portions and bulging in the middle portion, so that the mouthpiece perfectly matches a gap between closed upper and lower lips, thereby avoiding air leakage as a result of the gap between the upper and lower lips. Moreover, a protruding structure is disposed to further seal a gap between a side (Continued)

around the mouthpiece and the upper and lower lips, thereby improving air tightness between the mouthpiece and the lips.

3 Claims, 1 Drawing Sheet

(56) References Cited

U.S. PATENT DOCUMENTS

| | | | | |
|---|---|---|---|---|
| 2010/0031968 | A1* | 2/2010 | Sheikh | A24F 40/46 131/347 |
| 2017/0042246 | A1* | 2/2017 | Lau | H05B 1/0227 |
| 2018/0007958 | A1* | 1/2018 | Verbiest | A24B 15/167 |
| 2018/0098568 | A1* | 4/2018 | Qiu | A24F 7/00 |
| 2018/0338526 | A1* | 11/2018 | Ouyang | A24F 7/02 |
| 2018/0339118 | A1* | 11/2018 | Ouyang | A61M 11/042 |
| 2019/0099562 | A1* | 4/2019 | Nettenstrom | A61M 15/06 |
| 2019/0124996 | A1* | 5/2019 | Qiu | A24F 40/40 |
| 2019/0134320 | A1* | 5/2019 | Fornarelli | A61M 15/06 |
| 2019/0246693 | A1* | 8/2019 | Nettenstrom | A24F 40/485 |
| 2019/0274362 | A1* | 9/2019 | Newcomb | G06F 21/44 |
| 2020/0359690 | A1* | 11/2020 | Rado | A24F 40/85 |
| 2021/0267280 | A1* | 9/2021 | Zigmund | A24F 40/465 |

FOREIGN PATENT DOCUMENTS

| | | | |
|---|---|---|---|
| CN | 106235420 | A | 12/2016 |
| CN | 106686996 | A | 5/2017 |
| CN | 206933325 | U | 1/2018 |
| CN | 304510762 | S | 2/2018 |
| CN | 108420122 | A | 8/2018 |
| CN | 209449680 | U | 10/2019 |
| KR | 20160095694 | A | 8/2016 |
| WO | 2017163051 | A1 | 9/2017 |

OTHER PUBLICATIONS

International Search Report of corresponding PCT Patent Application No. PCT/CN2019/129441 dated Mar. 2, 2020.

* cited by examiner

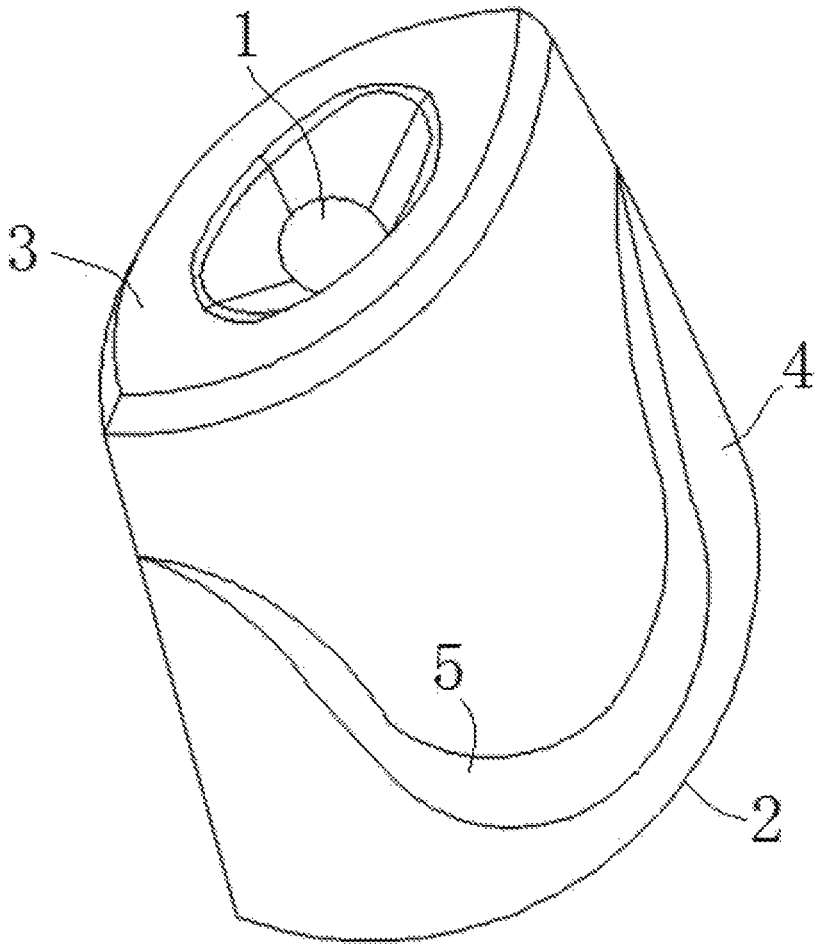
1
3
4
5
2

HIGH-COMFORT ELECTRONIC CIGARETTE MOUTHPIECE

CROSS REFERENCE TO RELATED APPLICATIONS

The present application claims the benefit of priority from the China Patent Application No. 201822256268.8, filed on 29 Dec. 2018, the disclosure of which is hereby incorporated by reference in its entirety.

BACKGROUND OF THE INVENTION

1. Field of the Invention

Embodiments of the present disclosure relate to the technical field of electronic cigarette accessories, and in particular, to a high-comfort electronic cigarette mouthpiece.

2. Description of the Related Art

Existing electronic cigarette products on the market have relatively traditional cartridge modelling. Due to a limitation to a cylindrical shape of traditional cigarettes for imitation and a limitation to the processing technology of a tobacco rod, the cartridge is designed to be of a regular shape such as a square-tapered shape. A cylindrical electronic cigarette mouthpiece is easy to make lips at two side portions not closed tightly, causing a problem of air leakage. However, the square-tapered electronic cigarette mouthpiece is easy to cut the lips due to edges and corners on the surface, causing a poor experience of the lips.

SUMMARY OF THE INVENTION

Therefore, embodiments of the present disclosure provide a high-comfort electronic cigarette mouthpiece, to resolve the problem of a poor lip touch experience due to inappropriate external shapes in the prior art.

In order to achieve the goal, the embodiments of the present disclosure provide the following technical solutions.

A high-comfort electronic cigarette mouthpiece is provided. A center of the mouthpiece is provided with a vent penetrating through the mouthpiece. Two ends of the mouthpiece are respectively an air inlet end and an air outlet end, and the cross-section of the mouthpiece gradually decreases from the air inlet end to the air outlet end in a streamlined manner, which is of a date-pit shape, an eye shape, or an oval shape that is pointed at two side portions and bulging in a middle portion.

In still another embodiment of the present disclosure, the cross-sectional length of the mouthpiece is in a range of 4 mm to 8.7 mm, the cross-sectional width of the mouthpiece is in a range of 10 mm to 20 mm, and the height from the air inlet end to the air outlet end of the mouthpiece is in a range of 11 mm to 22 mm.

In still another embodiment of the present disclosure, the mouthpiece is made of food-grade PCTG and has VDI18 fine textures.

In still another embodiment of the present disclosure, the air inlet end of the mouthpiece is provided with a protruding structure distributed around the mouthpiece, and a side edge of the protruding structure located at the air outlet end is an arc-shaped side edge like tightly closed upper and lower lips.

According to the embodiments of the present disclosure, there are following advantages.

In the embodiments of the present disclosure, the high-comfort electronic cigarette mouthpiece is designed to be of a streamlined shape that is pointed at two side portions and bulging in the middle portion, so that the mouthpiece perfectly matches a gap between closed upper and lower lips, thereby avoiding air leakage as a result of the gap between the upper and lower lips. Moreover, a protruding structure is disposed to further seal a gap between a side around the mouthpiece and the upper and lower lips, thereby improving air tightness between the mouthpiece and the lips.

BRIEF DESCRIPTION OF THE DRAWINGS

To describe the technical solutions of the implementations of the present disclosure or the prior art more clearly, the following briefly introduces the accompanying drawings required for describing the implementations or the prior art. Obviously, the accompanying drawings in the following descriptions are merely exemplary, and a person of ordinary skill in the art may further derive other accompanying drawings from the accompanying drawings without creative efforts.

The structures, proportions, sizes, and the like depicted in the specification merely serve to illustrate the disclosure of the specification to allow for reading and understanding by those skilled in the art, are not intended to limit the implementation of the present disclosure, and therefore do not constitute any substantial technical meaning. Any modification of a structure, alteration of a proportional relationship, or adjustment of a size shall still fall within the scope of the technical content disclosed in the present disclosure without affecting the effects and objectives of the present disclosure.

FIG. 1 is an overall structural diagram of a high-comfort electronic cigarette mouthpiece according to an embodiment of the present disclosure.

In the FIG:

1. Vent; 2. Air inlet end; 3. Air outlet end; 4. Protruding structure; 5. Arc-shaped side edge.

PREFERRED EMBODIMENT OF THE PRESENT INVENTION

The following describes implementations of the present disclosure by using specific embodiments. Those skilled in the art can easily understand other advantages and effects of the present disclosure from the content disclosed in this specification. Obviously, the described embodiments are some rather than all of the embodiments of the present disclosure. All other embodiments obtained by a person of ordinary skill in the art based on the embodiments of the present disclosure without creative effects shall fall within the protection scope of the present disclosure.

In addition, terms such as "above", "below", "left", "right", "middle", and the like in the specification are only used for the clarity of description, and are not intended to limit the implementation scope of the present disclosure. Without substantially changing the technical content, an alteration or adjustment of the relative relationship of such terms shall be construed as falling within the implementation scope of the present disclosure.

FIG. 1 shows a high-comfort electronic cigarette mouthpiece. A center of the mouthpiece is provided with a vent 1 penetrating through the mouthpiece. Two ends of the mouthpiece are respectively an air inlet end 2 and an air outlet end 3, and the cross-section of the mouthpiece gradually decreases from the air inlet end 2 to the air outlet end 3 in a streamlined manner, which is of a date-pit shape, an eye shape, or an oval shape that is pointed at two side portions and bulging in a middle portion. The cross-sectional length of the mouthpiece is in a range of 4 mm to 8.7 mm, the cross-sectional width of the cigarette holder is in a range of 10 mm to 20 mm, and the height from the air inlet end 2 to the air outlet end 3 of the mouthpiece is in a range of 11 mm to 22 mm A mouthpiece with a size less than the size range are not filled with lips fully, and there is a gap between the lips and the mouthpiece, but a size greater than the size range may cause insufficient sealing at a position in which lips are closed and that is at two side portions of the mouthpiece, which may cause air leakage. The mouthpiece is made of food-grade PCTG and has VDI18 fine textures.

The air inlet end 2 of the mouthpiece is provided with a protruding structure 4 distributed around the mouthpiece, and a side edge of the protruding structure 4 located at the air outlet end 3 is an arc-shaped side edge 5 like tightly closed upper and lower lips. The arc-shaped side edge 5 may better seal the closed lips, and two side surfaces are attached to the upper and lower lips, so that the mouthpiece and the closed lips are closely attached. The shape and size of the mouthpiece in this embodiment can be optimally attached to the upper and lower lips.

Although the present disclosure has been described in detail above by using the general description and specific embodiments, it is apparent to those skilled in the art that some modifications or improvements may be made based on the present disclosure. Therefore, such modifications or improvements made without departing from the spirit of the present disclosure shall fall within the protection scope of the present disclosure.

What is claimed is:

1. A high-comfort electronic cigarette mouthpiece, a center of the mouthpiece being provided with a vent penetrating through the mouthpiece, wherein two ends of the mouthpiece are respectively an air inlet end and an air outlet end, and the cross-section of the mouthpiece gradually decreases from the air inlet end to the air outlet end in a streamlined manner, the cross-section of the mouthpiece is of a date-pit shape, an eye shape, or an oval shape that is pointed at two side portions and bulging in a middle portion; wherein the air inlet end of the mouthpiece is provided with a protruding structure distributed around the mouthpiece, and a side edge of the protruding structure located at the air outlet end is an arc-shaped side edge like tightly closed upper and lower lips.

2. The high-comfort electronic cigarette mouthpiece according to claim 1, wherein the cross-sectional length of the mouthpiece is in a range of 4 mm to 8.7 mm, the cross-sectional width of the mouthpiece is in a range of 10 mm to 20 mm, and the height from the air inlet end to the air outlet end of the mouthpiece is in a range of 11 mm to 22 mm.

3. The high-comfort electronic cigarette mouthpiece according to claim 1, wherein the mouthpiece is made of food-grade PCTG and has VDI18 fine textures.

* * * * *